US007370638B2

(12) United States Patent
Hayakawa

(10) Patent No.: US 7,370,638 B2
(45) Date of Patent: May 13, 2008

(54) FUEL INJECTION CONTROL SYSTEM ENSURING STEADY BALANCE IN PRESSURE IN ACCUMULATOR

(75) Inventor: Yoshiki Hayakawa, Kuwana (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/633,632

(22) Filed: Dec. 5, 2006

(65) Prior Publication Data

US 2007/0125343 A1 Jun. 7, 2007

(30) Foreign Application Priority Data

Dec. 5, 2005 (JP) ..... 2005-350708

(51) Int. Cl.
*F02M 37/04* (2006.01)

(52) U.S. Cl. ..... 123/467; 123/479

(58) Field of Classification Search ..... 123/467, 123/456, 479, 198 D, 494
See application file for complete search history.

(56) References Cited

U.S. PATENT DOCUMENTS 4,487,184 A * 12/1984 Böning et al. ..... 123/435
4,499,876 A * 2/1985 Yamamoto ..... 123/446
4,777,921 A 10/1988 Miyaki et al.
5,417,194 A * 5/1995 Augustin ..... 123/456
5,492,099 A * 2/1996 Maddock ..... 123/446
5,535,621 A * 7/1996 Glidewell et al. ..... 73/119 A
5,711,273 A * 1/1998 Barnes et al. ..... 123/446
5,727,516 A * 3/1998 Augustin et al. ..... 123/198 DB
6,024,064 A * 2/2000 Kato et al. ..... 123/179.17
6,546,912 B2 * 4/2003 Tuken ..... 123/436
6,715,468 B2 * 4/2004 Uchiyama et al. ..... 123/339.15

FOREIGN PATENT DOCUMENTS

JP 62-258160 11/1987

* cited by examiner

*Primary Examiner*—Carl S. Miller
(74) *Attorney, Agent, or Firm*—Nixon & Vanderhye P.C.

(57) ABSTRACT

An accumulator fuel injection system working to energize fuel injectors to inject fuel at a sequence of injection timings into an internal combustion engine and also to control a fuel pump to feed the fuel to an accumulator at a sequence of controlled times for compensating for the amount of the fuel flowing out of the accumulator under feedback control. When having found a failure in operation of at least one of the fuel injectors, the system alters a mode of the feedback control to decrease the amount of fuel fed to the accumulator at one of the sequence of the controlled times which is at a selected interval away from one of the sequence of the injection timings at which the at least one of the fuel injectors is to be energized, thereby ensuring a steady balance between the amounts of fuel flowing into and out of the accumulator.

6 Claims, 14 Drawing Sheets

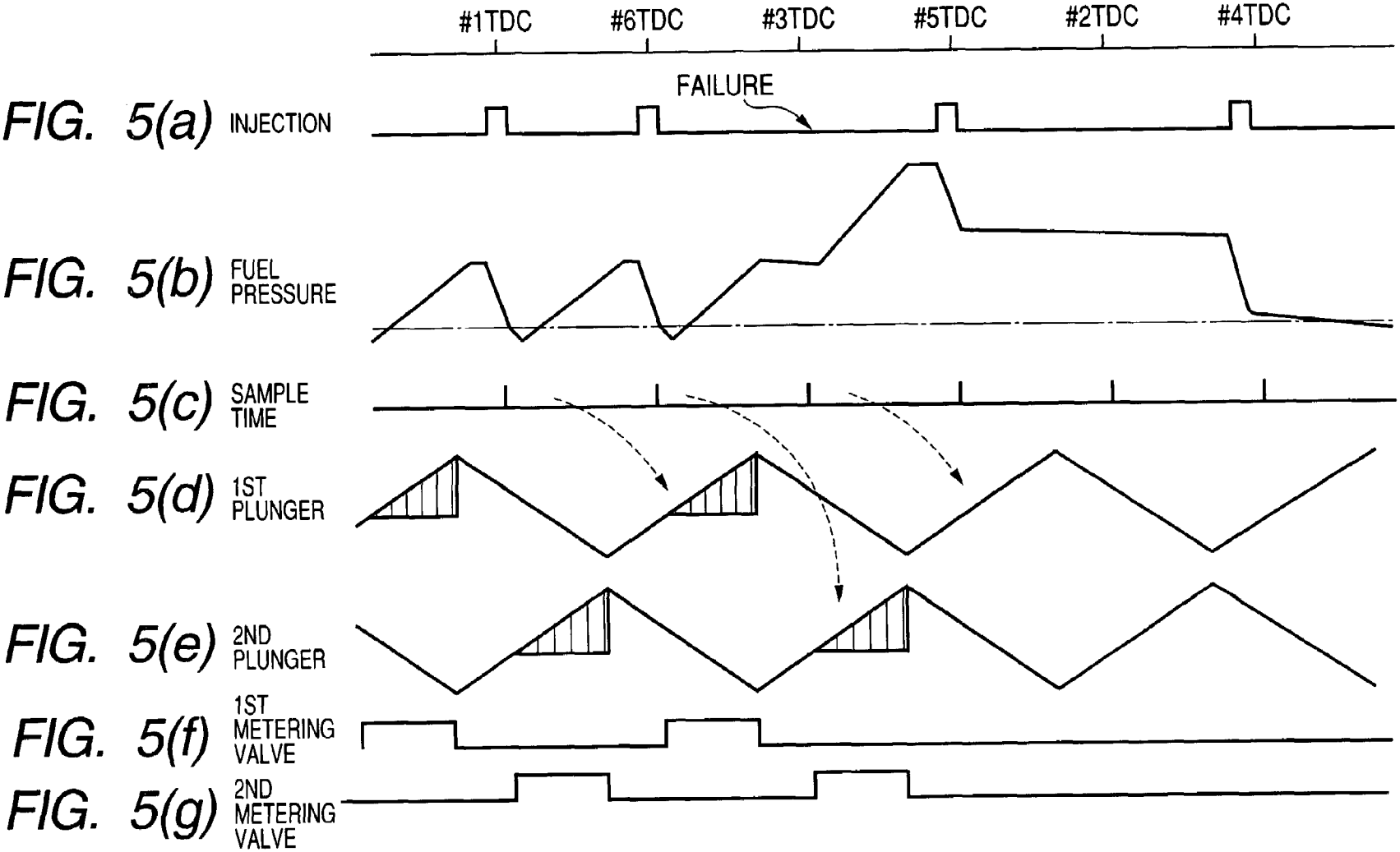
#1TDC
#6TDC
#3TDC
#5TDC
#2TDC
#4TDC
FAILURE
FIG. 5(a) INJECTION
FIG. 5(b) FUEL PRESSURE
FIG. 5(c) SAMPLE TIME
FIG. 5(d) 1ST PLUNGER
FIG. 5(e) 2ND PLUNGER
FIG. 5(f) 1ST METERING VALVE
FIG. 5(g) 2ND METERING VALVE

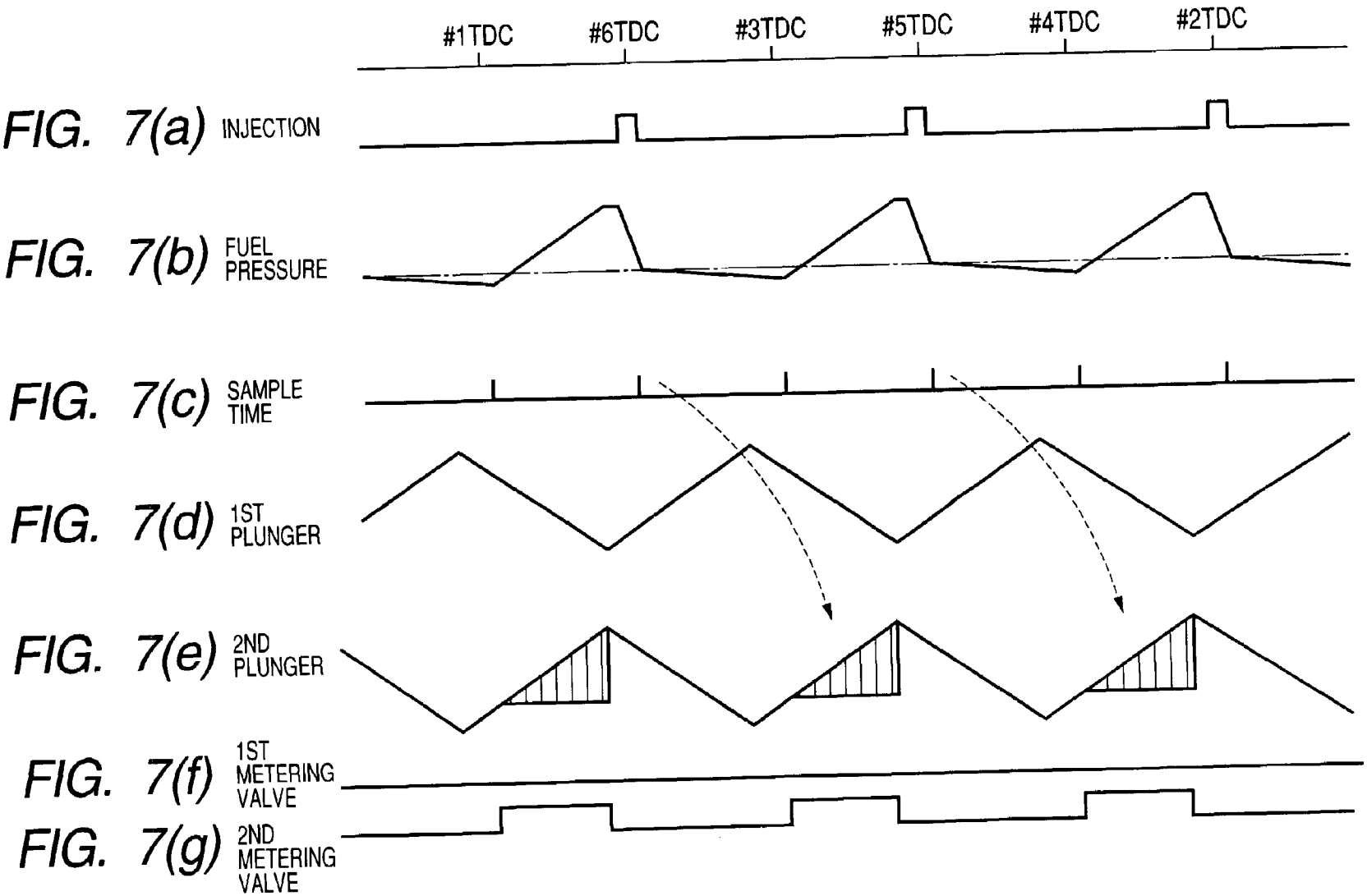
#1TDC
#6TDC
#3TDC
#5TDC
#4TDC
#2TDC
FIG. 7(a) INJECTION
FIG. 7(b) FUEL PRESSURE
FIG. 7(c) SAMPLE TIME
FIG. 7(d) 1ST PLUNGER
FIG. 7(e) 2ND PLUNGER
FIG. 7(f) 1ST METERING VALVE
FIG. 7(g) 2ND METERING VALVE

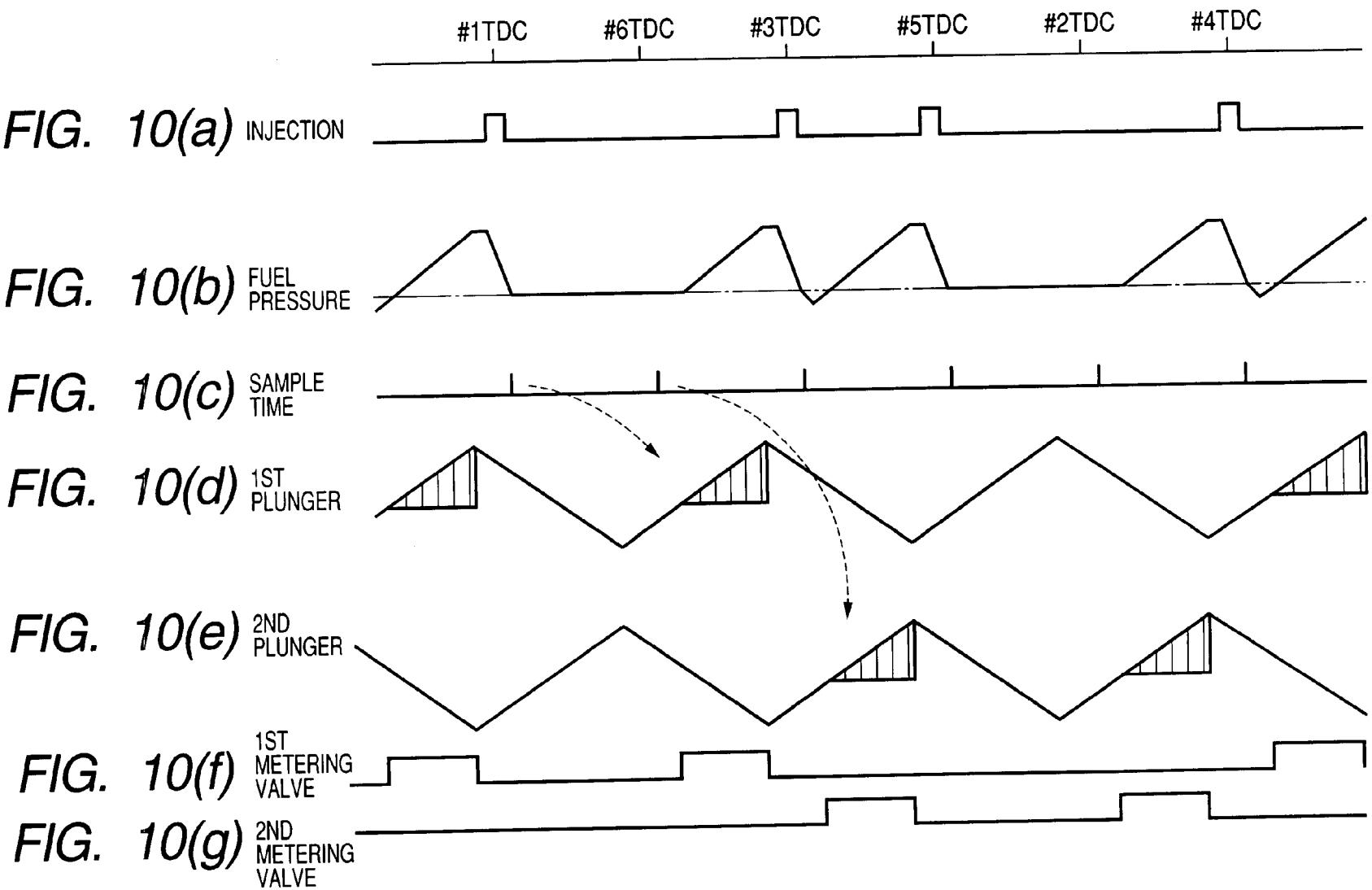
#1TDC
#6TDC
#3TDC
#5TDC
#2TDC
#4TDC
FIG. 10(a) INJECTION
FIG. 10(b) FUEL PRESSURE
FIG. 10(c) SAMPLE TIME
FIG. 10(d) 1ST PLUNGER
FIG. 10(e) 2ND PLUNGER
FIG. 10(f) 1ST METERING VALVE
FIG. 10(g) 2ND METERING VALVE

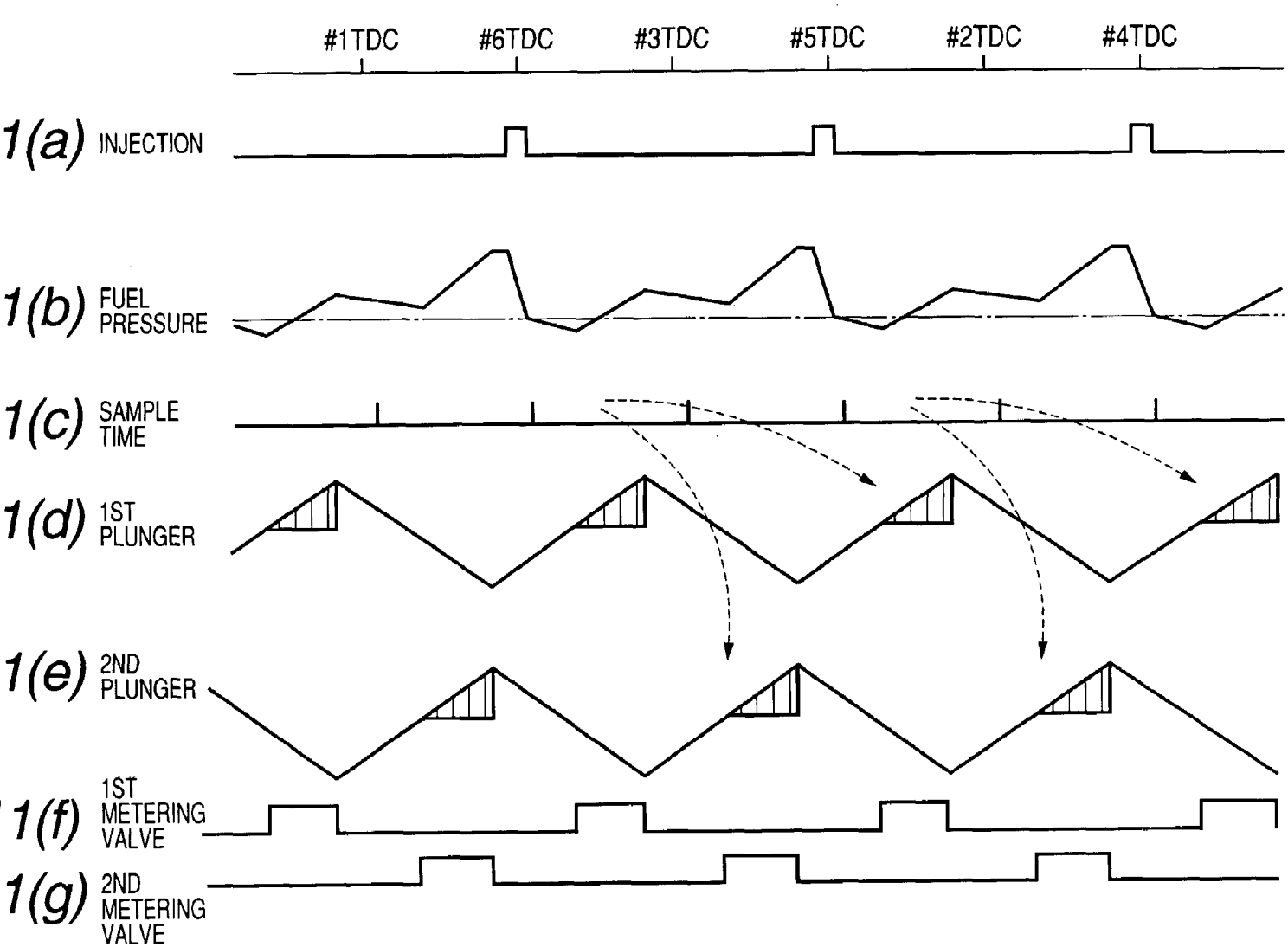
#1TDC
#6TDC
#3TDC
#5TDC
#2TDC
#4TDC
FIG. 11(a) INJECTION
FIG. 11(b) FUEL PRESSURE
FIG. 11(c) SAMPLE TIME
FIG. 11(d) 1ST PLUNGER
FIG. 11(e) 2ND PLUNGER
FIG. 11(f) 1ST METERING VALVE
FIG. 11(g) 2ND METERING VALVE

FUEL INJECTION CONTROL SYSTEM ENSURING STEADY BALANCE IN PRESSURE IN ACCUMULATOR

CROSS REFERENCE TO RELATED DOCUMENT

The present application claims the benefits of Japanese Patent Application No. 2005-350708 filed on Dec. 5, 2005, the disclosure of which is incorporated herein by reference.

BACKGROUND OF THE INVENTION

1. Technical Field of the Invention

The present invention relates generally to a fuel injection control system equipped with a fuel accumulator and a fuel injector working to inject fuel supplied from the fuel accumulator, and more particularly to such a system designed to ensure the steady balance between amounts of fuel fed to and discharged from the accumulator.

2. Background Art

There are known common rail fuel injection systems for diesel engines of automotive vehicles which are equipped with a controller, a common rail, and a fuel pump. For example, Japanese Patent First Publication No. 62-258160 discloses a typical common rail injection system. The common rail injection system is typically designed to determine a target pressure of fuel in the common rail depending upon operating conditions of an engine to change the pressure of fuel to be supplied to fuel injectors.

The common rail injection system usually works to control the feeding of fuel from the fuel pump to the common rail to bring the pressure in the common rail, as measured by a fuel pressure sensor, into agreement with the target value under feedback control. For instance, the system calculates a proportional term and an integral term in a PI algorithm based on the pressure in the common rail and the target pressure to determine a target amount of fuel to be discharged by the fuel pump and converts it into an electric current for driving the fuel pump to feed the target amount of the fuel to the common rail to bring the pressure into agreement with the target value.

In the case of use in a synchronous mode to synchronize the feeding of the fuel to the common rail with each injection of the fuel into the engine, the common rail fuel injection system is required to feed the amount of fuel to the common rail which compensates for the amount of fuel consumed by injection into the engine to ensure steady balance between the amounts of fuel flowing into and out of the common rail.

If, however, a failure has occurred in energizing one(s) of fuel injectors due to, for example, a disconnection of an injector's power supply line or one(s) of the fuel injectors encounters mechanical or electrical trouble in itself, it will result in instability in synchronization of the feeding of fuel to the common rail with the injection of fuel into the engine, thus leading to an unbalance between the amounts of fuel flowing into and out of the common rail. This results in an increased variation in pressure of the fuel in the common rail and lowered controllability of the pressure in the common rail.

SUMMARY OF THE INVENTION

It is therefore a principal object of the invention to avoid the disadvantages of the prior art.

It is another object of the invention to provide a fuel injection control system which is equipped with an accumulator in which fuel is stored for injection thereof into an engine and designed to ensure steady balance between amounts of fuel flowing into and out of the accumulator.

According to one aspect of the invention, there is provided a fuel injection control system which may be employed for automotive common rail diesel engines. The fuel injection control system comprises: (a) a fuel pump works to feed fuel; (b) an accumulator in which the fuel fed from the fuel pump is to be accumulated at a given pressure; (c) fuel injectors each of which works to inject the fuel supplied from the accumulator into one of cylinders of a multi-cylinder internal combustion engine; (d) a fuel pressure sensor working to measure a pressure of the fuel in the accumulator; and (e) a controller working to energize the fuel injectors to inject the fuel at a sequence of given injection timings into the cylinders of the engine and also to control an operation of the fuel pump to feed an amount of the fuel to the accumulator at a sequence of controlled times for compensating for an amount of the fuel which flows out of the accumulator to bring the pressure of the fuel in the accumulator, as measured by the fuel pressure sensor, into agreement with a target value under feedback control. The controller is designed to perform a diagnosis function to diagnose whether at least one of the fuel injector has failed in operation or not. When it is determined that at least one of the fuel injectors has failed in operation, the controller alters a mode of the feedback control to decrease the amount of fuel fed from the fuel pump to the accumulator at one of the sequence of the controlled times which is at a selected interval away from one of the sequence of the injection timings at which the at least one of the fuel injectors is to be energized to inject the fuel into the engine, thereby avoiding feeding of an excessive amount of fuel to the accumulator near the time when the fuel injector determined to have failed in operation is to be energized to ensure a steady balance between the amounts of fuel flowing into and out of the accumulator to keep a variation in pressure in the accumulator within an allowable range. This also ensures the controllability of the pressure of the fuel in the accumulator.

In the preferred mode of the invention, the controller works in a synchronization mode to control the operation of the fuel pump to feed the amount of the fuel to the accumulator synchronously with the injection of the fuel into the engine through each of the fuel injectors. When it is determined that the at least one of the fuel injectors has failed in operation, the controller may alter the mode of the feedback control to decrease the amount of fuel fed from the fuel pump to the accumulator at one of the sequence of the controlled times which is adjacent to one of the sequence of the injection timings at which the at least one of the fuel injectors is to be energized to inject the fuel into the engine.

The fuel injectors may be broken down into groups. The fuel injection control system further comprises power supply lines each of which supplies electric power to energize one of the groups of said fuel injectors. The fuel pump is equipped with metering valves, one for each of the groups of the fuel injectors, which work to regulate the fuel fed from the fuel pump to the accumulator to an amount required by the controller. When it is determined that the at least one of the fuel injectors has failed in operation, the controller may work to alter the mode of the feedback control to decrease the amount of fuel, as regulated by one of the metering valves which is associated with one of the groups including the at least one of the fuel injectors.

When it is determined that the at least one of the fuel injectors has failed in operation, the controller may work to alter the mode of the feedback control to decrease the amount of fuel, as regulated by the one of the metering valves which is associated with the one of the groups including the at least one of the fuel injectors to zero.

When it is determined that the at least one of the fuel injectors has failed in operation, the controller may work to alter the mode of the feedback control to decrease the amount of fuel, as regulated by the one of the metering valves which is associated with the one of the groups including the at least one of the fuel injectors to a predetermined value.

In the case where the controller works in the synchronization mode to control the operation of the fuel pump to feed the amount of the fuel to the accumulator synchronously with the injection of the fuel into the engine through each of the fuel injectors to bring the pressure of the fuel in the accumulator, as sampled through the fuel pressure sensor in a sampling cycle, into agreement with the target value under the feedback control, when it is determined that at least one of the fuel injectors has failed in operation, the controller may work to alter the mode of the feedback control to change the sampling cycle.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 4(*b*) demonstrates a change in pressure of fuel in a common rail of the fuel injection system of FIG. 1 when steady balance between amounts of fuel flowing into and out of the common rail is established by feedback control of the pressure in the common rail;

FIG. 4(*c*) demonstrates sample times when a microcomputer of the fuel injection control system of FIG. 1 samples an output of a fuel pressure sensor for use in feedback control of the pressure in a common rail;

FIG. 4(*d*) demonstrates feeding of fuel by strokes of a first plunger of a fuel pump;

FIG. 4(*e*) demonstrates feeding of fuel by strokes of a second plunger of a fuel pump;

FIG. 4(*f*) demonstrates durations for which a first metering pump is opened;

FIG. 4(*g*) demonstrates durations for which a second metering pump is opened;

FIG. 5(*a*) demonstrates an injection period for which each fuel injector of the fuel injection system of FIG. 1 is opened to spray fuel into an engine in the event of a failure in operation of two of the fuel injectors;

FIG. 5(*b*) demonstrates a change in pressure of fuel in a common rail of the fuel injection system of FIG. 1 when an unbalance between amounts of fuel flowing into and out of the common rail is resulted from a failure in operation of a fuel injector;

FIG. 5(*c*) demonstrates sample times when a microcomputer of the fuel injection control system of FIG. 1 samples an output of a fuel pressure sensor for use in feedback control of the pressure in a common rail;

FIG. 5(*d*) demonstrates feeding of fuel by strokes of a first plunger of a fuel pump;

FIG. 5(*e*) demonstrates feeding of fuel by strokes of a second plunger of a fuel pump;

FIG. 5(*f*) demonstrates durations for which a first metering pump is opened;

FIG. 5(*g*) demonstrates durations for which a second metering pump is opened;

FIG. 7(*a*) demonstrates an injection period for which each fuel injector of the fuel injection system of FIG. 1 is opened to spray fuel into an engine;

FIG. 7(*b*) demonstrates a change in pressure of fuel in a common rail of the fuel injection system of FIG. 1 which a steady balance between amounts of fuel flowing into and out of a common rail is established by the operation of FIG. 6;

FIG. 7(*c*) demonstrates sample times when a microcomputer of the fuel injection control system of FIG. 1 samples an output of a fuel pressure sensor for use in feedback control of the pressure in a common rail;

FIG. 7(*d*) demonstrates feeding of fuel by strokes of a first plunger of a fuel pump;

FIG. 7(*e*) demonstrates feeding of fuel by strokes of a second plunger of a fuel pump;

FIG. 7(*f*) demonstrates durations for which a first metering pump is opened;

FIG. 7(*g*) demonstrates durations for which a second metering pump is opened;

FIG. 8(*b*) demonstrates a change in pressure of fuel in a common rail of a fuel injection system of the second embodiment in which a steady balance between amounts of fuel flowing into and out of a common rail is established by a fail-safe operation;

FIG. 8(*c*) demonstrates sample times when a microcomputer of a fuel injection control system of the second embodiment samples an output of a fuel pressure sensor for use in feedback control of the pressure in a common rail;

FIG. 8(*d*) demonstrates feeding of fuel by strokes of a first plunger of a fuel pump;

FIG. 8(*e*) demonstrates feeding of fuel by strokes of a second plunger of a fuel pump;

FIG. 8(*f*) demonstrates durations for which a first metering pump is opened;

FIG. 8(*g*) demonstrates durations for which a second metering pump is opened;

FIG. 10(*a*) demonstrates an injection period for which each fuel injector of a fuel injection system of the fourth embodiment is opened to spray fuel into an engine in the event of a failure in operation of two of the fuel injectors;

FIG. 10(*b*) demonstrates a change in pressure of fuel in a common rail of a fuel injection system of the fourth embodiment in which a steady balance between amounts of fuel flowing into and out of a common rail is established by a fail-safe operation;

FIG. 10(*c*) demonstrates sample times when a microcomputer of a fuel injection control system of the fourth embodiment samples an output of a fuel pressure sensor for use in feedback control of the pressure in a common rail;

FIG. 10(*d*) demonstrates feeding of fuel by strokes of a first plunger of a fuel pump;

FIG. 10(*e*) demonstrates feeding of fuel by strokes of a second plunger of a fuel pump;

FIG. 10(*f*) demonstrates durations for which a first metering pump is opened;

FIG. 10(*g*) demonstrates durations for which a second metering pump is opened;

FIG. 11(*a*) demonstrates an injection period for which each fuel injector of a fuel injection system of the fifth embodiment is opened to spray fuel into an engine in the event of a failure in operation of two of the fuel injectors;

FIG. 11(*b*) demonstrates a change in pressure of fuel in a common rail of a fuel injection system of the fifth embodiment in which a steady balance between amounts of fuel flowing into and out of a common rail is established by a fail-safe operation;

FIG. 11(*c*) demonstrates sample times when a microcomputer of a fuel injection control system of the fifth embodiment samples an output of a fuel pressure sensor for use in feedback control of the pressure in a common rail;

FIG. 11(*d*) demonstrates feeding of fuel by strokes of a first plunger of a fuel pump;

FIG. 11(*e*) demonstrates feeding of fuel by strokes of a second plunger of a fuel pump;

FIG. 11(*f*) demonstrates durations for which a first metering pump is opened;

FIG. 11(*g*) demonstrates durations for which a second metering pump is opened;

FIG. 12(*b*) demonstrates a change in pressure of fuel in a common rail of a modified form of a fuel injection system of the fourth embodiment in which a steady balance between amounts of fuel flowing into and out of a common rail is established by a fail-safe operation;

FIG. 12(*c*) demonstrates sample times when a microcomputer of a modified form of a fuel injection control system of the fourth embodiment samples an output of a fuel pressure sensor for use in feedback control of the pressure in a common rail;

FIG. 12(*d*) demonstrates feeding of fuel by strokes of a first plunger of a fuel pump;

FIG. 12(*e*) demonstrates feeding of fuel by strokes of a second plunger of a fuel pump;

FIG. 12(*f*) demonstrates durations for which a first metering pump is opened;

FIG. 12(*g*) demonstrates durations for which a second metering pump is opened;

FIG. 13(*b*) demonstrates a change in pressure of fuel in a common rail of a modification of a fuel injection system in which a steady balance between amounts of fuel flowing into and out of a common rail is established;

FIG. 13(*c*) demonstrates sample times when a microcomputer of a modification of a fuel injection control system samples an output of a fuel pressure sensor for use in feedback control of the pressure in a common rail;

FIG. 13(*d*) demonstrates feeding of fuel by strokes of a first plunger of a fuel pump;

FIG. 13(*e*) demonstrates feeding of fuel by strokes of a second plunger of a fuel pump;

FIG. 13(*f*) demonstrates durations for which a first metering pump is opened;

FIG. 13(*g*) demonstrates durations for which a second metering pump is opened;

FIG. 14(*b*) demonstrates a change in pressure of fuel in a common rail of the fuel injection system, as referred to in FIG. 14(*b*), in which a steady balance between amounts of fuel flowing into and out of a common rail is established by a fail-safe operation;

FIG. 14(*c*) demonstrates sample times when a microcomputer of the fuel injection control system, as referred to in FIG. 13(*c*), samples an output of a fuel pressure sensor for use in feedback control of the pressure in a common rail;

FIG. 14(*d*) demonstrates feeding of fuel by strokes of a first plunger of a fuel pump;

FIG. 14(*e*) demonstrates feeding of fuel by strokes of a second plunger of a fuel pump;

FIG. 14(*f*) demonstrates durations for which a first metering pump is opened; and FIG. 14(*g*) demonstrates durations for which a second metering pump is opened.

DESCRIPTION OF THE PREFERRED EMBODIMENTS

Figure 1:
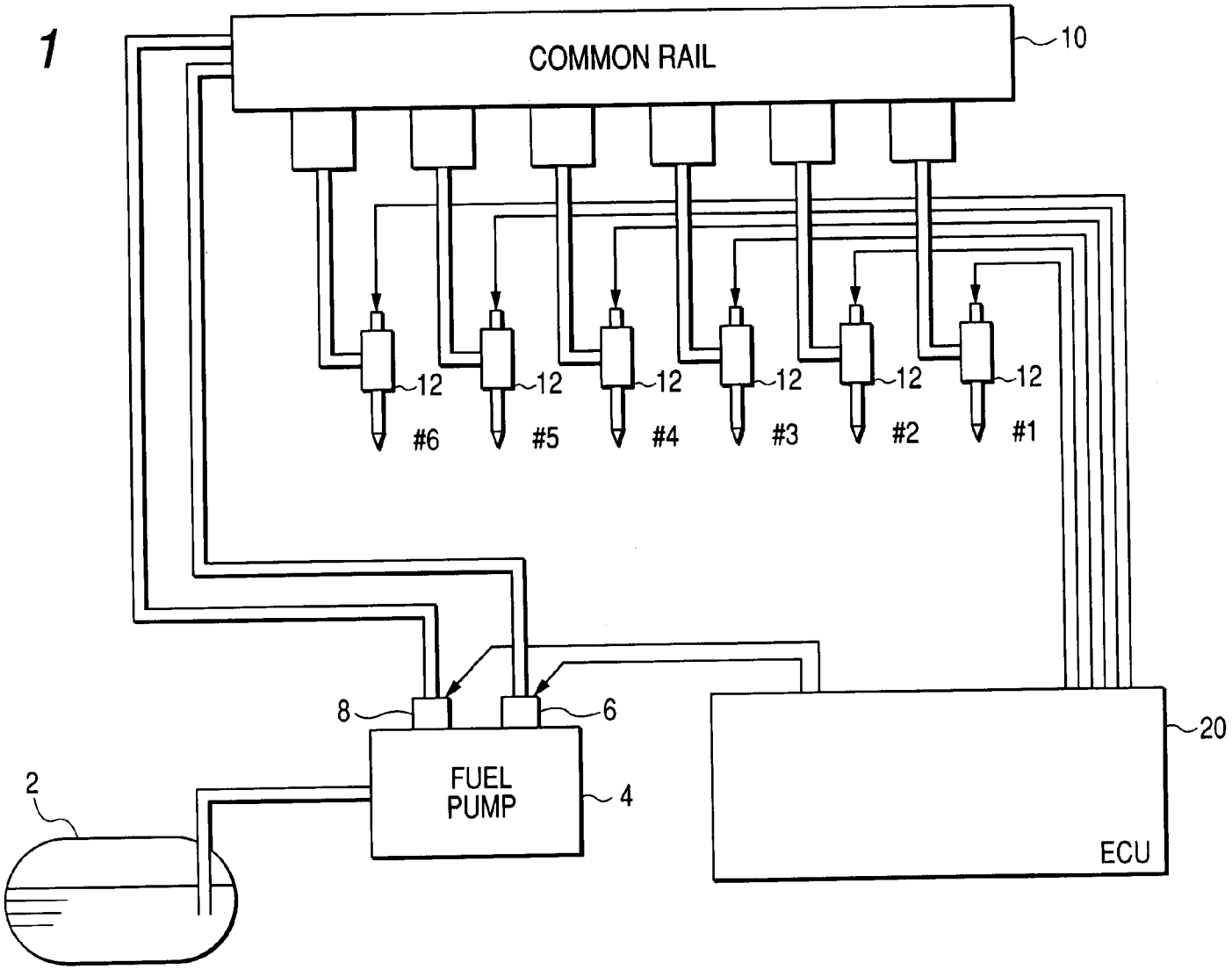
FIG. 1 is a block diagram which shows a fuel injection control system according to the first embodiment of the invention.

Referring to the drawings, wherein like reference numbers refer to like parts in several views, particularly to FIG. 1, there is shown an engine control system according to the first embodiment of the invention which is designed, as an example, as a common rail injection system (also called an accumulator injection system) working to control injection of fuel into a diesel engine.

A fuel pump 4 works to pump fuel out of a fuel tank 2 and supply it to a common rail 10. The fuel pump 4 is equipped with a first and a second plunger (not shown) and a first and a second metering valve 6 and 8. Each of the first and second metering valves 6 and 8 is designed as a discharge control valve (also called a pump control valve) to control the amount of fuel sucked from the fuel tank 4 to be discharged to the common rail 10. Specifically, each of the first and second metering valves 6 and 8 is controlled by an electronic control unit (ECU) 20 to be opened during an interval in which a corresponding one of the first and second plungers moves from the bottom dead center to the top dead center thereof, thereby controlling the amount of fuel to be discharged to the common rail 10. The metering valves 6 and 8 will also be referred to as first and second discharge control valves, respectively.

The common rail 10 serves as an accumulator in which the fuel fed from the discharge control valves 6 and 8 is stored under a given high pressure and supplied to each of fuel injectors 12 installed in a diesel engine (not shown). The following discussion will refer, as an example, to the six-cylinder diesel engine.

The electronic control unit 20 works to control operations of the first and second discharge control valves 6 and 8 and the fuel injectors 12 to control an output of the diesel engine.

Figure 2:
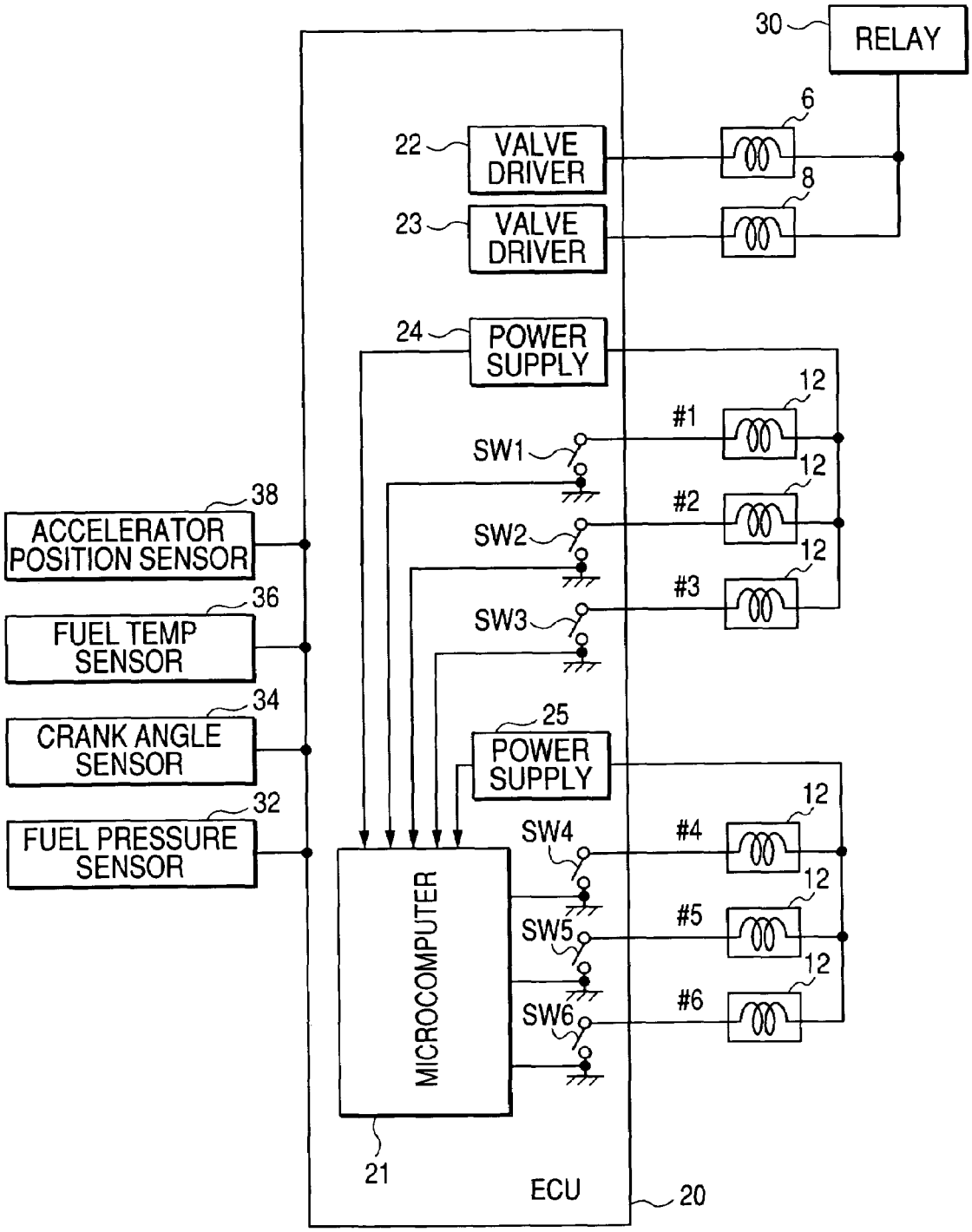
FIG. 2 is a circuit diagram which shows an internal structure of an electronic control unit of the fuel injection control system of FIG. 1 connecting with peripheral devices.

The electronic control unit 20, as illustrated in FIG. 2, includes a microcomputer 21, a first discharge control valve driver 22, and a second discharge control valve driver 23. The first and second discharge control valve drivers 22 and 23 work to control the operations of the first and second discharge control valves 6 and 8, respectively. The first discharge control valve driver 22 establishes a power supply line for the first discharge control valve 6 though a relay 30. Similarly, the second discharge control valve driver 23 establishes a power supply line for the second discharged control valve 8 through the relay 30.

The ECU 20 also includes power supply circuits 22 and 23. The power supply circuit 24 serves to supply electric power to three of the fuel injectors 12 for the first, second, and third cylinders #1, #2, and #3 of the engine and is equipped with a step-up transformer and a constant current supply. Similarly, the power supply circuit 25 serves to supply electric power to the rest of the fuel injectors 12 for the fourth, fifth, and sixth cylinders #4, #5, and #6 of the engine and is equipped with a step-up transformer and a constant current supply. The ECU 20 also includes switching devices SW1 to SW6 which work to establish or block electrical connections between the fuel injectors 12 and ground. The power supply circuit 24, the switching devices SW1 to SW3, and corresponding three of the fuel injectors 12 establish a power supply line for supplying the electric power to the fuel injectors 12 for the first to third cylinders #1 to #3 of the engine. Similarly, the power supply circuit 25, the switching devices SW4 to SW6, and corresponding three of the fuel injectors 12 establish a power supply line for supplying the electric power to the fuel injectors 12 for the fourth to sixth cylinders #4 to #6 of the engine. Specifically, the fuel injectors 12 are broken down into two group: a first group consisting of three of the fuel injectors 12 for the first to third cylinders #1 to #3 of the engine and a second group consisting of the rest of the fuel injectors 12 for the fourth to sixth cylinders #4 to #6 of the engine. Each of the power supply lines is used for one of the first and second groups.

The ECU 20 is also connected to a fuel pressure sensor 32, a crank angle sensor 34, a fuel temperature sensor 36, and an accelerator position sensor 38. The fuel pressure sensor 32 works to measure the pressure of fuel in the common rail 10 and output a signal indicative thereof to the ECU 20. The crank angle sensor 34 works to measure an angular position of a crankshaft of the engine and output a signal indicative thereof to the ECU 20. The fuel temperature sensor 36 works to measure the temperature of fuel in the common rail 10 and output a signal indicative thereof to the ECU 20. The accelerator position sensor 38 works to measure a driver's effort on an accelerator pedal of the vehicle (i.e., the position of the accelerator pedal) and output a signal indicative thereof to the ECU 20.

Figure 3:
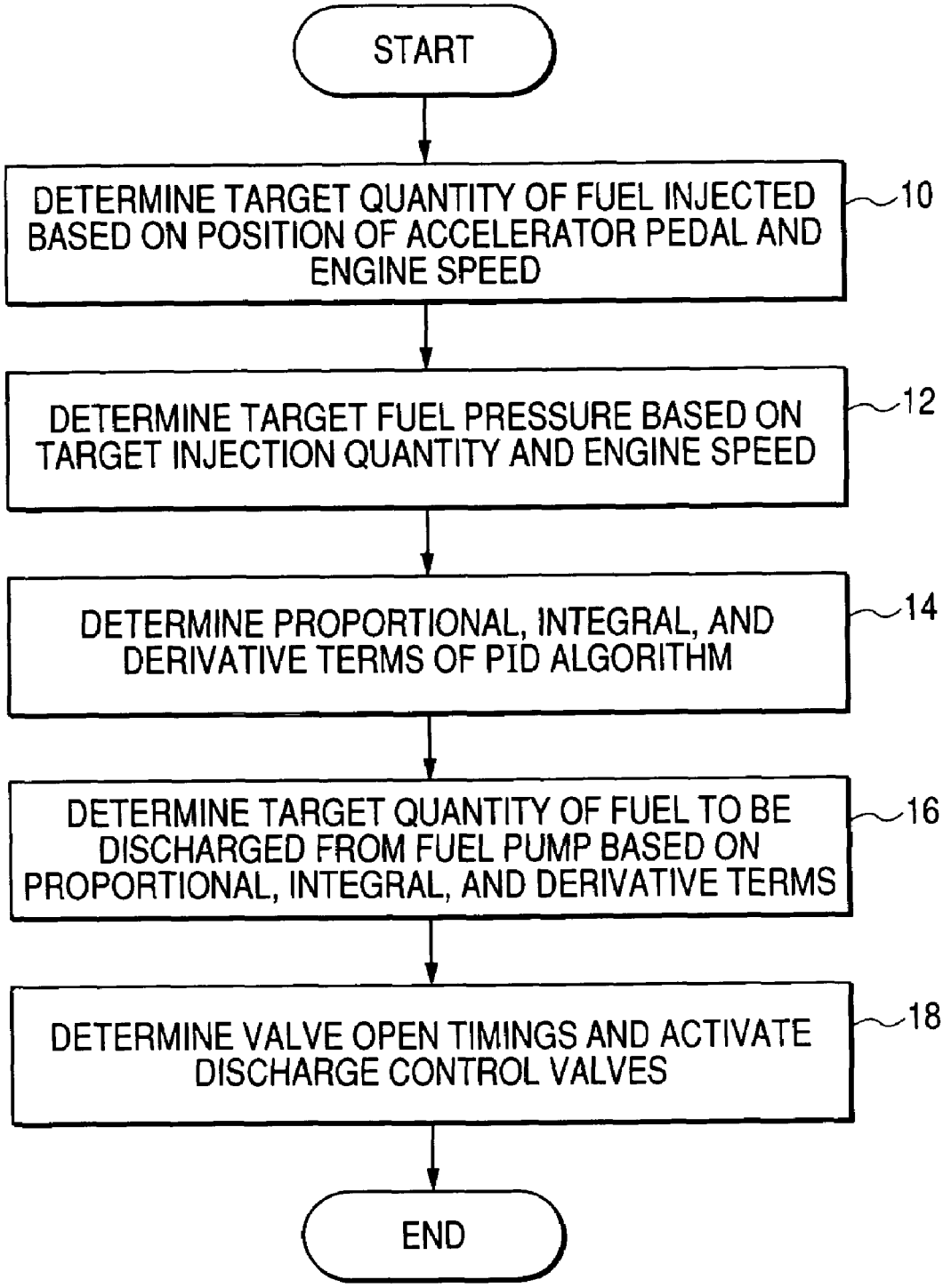
FIG. 3 is a flowchart of a feedback control program to control the pressure in a common rail of the fuel injection control system of FIG. 1.

The ECU 20 samples the outputs of the sensors 32 to 38 and controls the output of the diesel engine. Specifically, the ECU 20 works to control the operations of the discharge control valve 6 and 8 to bring the pressure in the common rail 10 into agreement with a target value under feedback control. This will be described below in detail with reference to a flowchart of a fuel pressure feedback control program, as illustrated in FIG. 3, which is to be executed by the microcomputer 21 in a cycle.

After entering the program, the routine proceeds to step 10 wherein outputs of the accelerator position sensor 38 and the crank angle sensor 34 are sampled to determine a required load on the engine and the speed of the engine, respectively. A target quantity of fuel to be injected by each of the fuel injectors 12 into the engine is calculated based on the required load and the speed of the engine.

The routine proceeds to step 12 wherein a target pressure of the fuel in the common rail 10 is calculated based on the target quantity of fuel injected and the speed of the engine.

The routine proceeds to step 14 wherein a proportional, an integral, and a derivative term of a PID (proportional-integral-derivative) algorithm based on a difference between the pressure of fuel in the common rail 10, as measured by the fuel pressure sensor 32, and the target pressure, as derived in step 12. Specifically, the microcomputer 21 works to perform the PID control to regulate the pressure of fuel in the common rail 10 so as to eliminate the difference between the pressure of fuel in the common rail 10, as measured by the fuel pressure sensor 32, and the target pressure.

The routine proceeds to step 16 wherein a target quantity of fuel to be discharged from the fuel pump 4 (i.e., the discharge control valves 6 and 8) is determined based on the proportional, integral, and derivative terms, as derived in step 14.

The routine proceeds to step 18 wherein timings when the discharge control valves 6 and 8 to be activated or opened are determined which establish the target quantity of fuel to be fed from the fuel pump 4 to the common rail 10. The microcomputer 21 then actuates the discharge control valves 6 and 8 at the determined timings through the discharge control valve drivers 22 and 23.

The above feedback control of the fuel in the common rail 10 will be described below with reference to FIGS. 4(*a*) to 4(*g*).

Figures 4A, 4B, 4C, 4D, 4E, 4F, 4G:
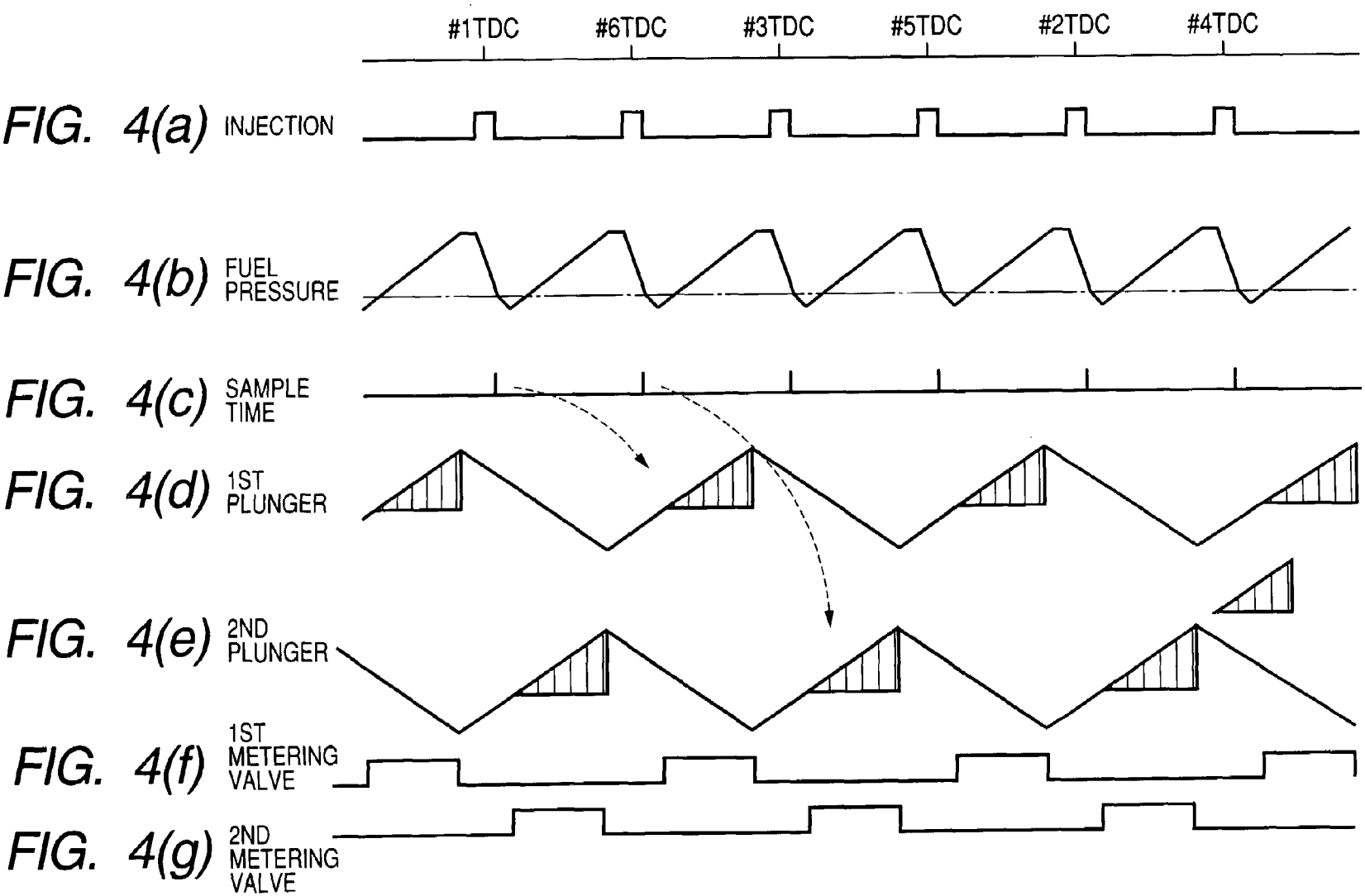
FIG. 4(*a*) demonstrates an injection period for which each fuel injector of the fuel injection system of FIG. 1 is opened to spray fuel into an engine in the absence of a failure in operation of the fuel injectors.

FIG. 4(*a*) demonstrates an injection period for which each of the fuel injectors 12 is opened to spray the fuel into a corresponding one of the cylinders of the engine. FIG. 4(*b*) demonstrates a change in pressure of the fuel in the common rail 10. FIG. 4(*c*) demonstrates sample times when the microcomputer 12 samples the output of the fuel pressure sensor 32 for use in the feedback control. FIG. 4(*d*) demonstrates strokes of the first plunger of the fuel pump 4. FIG. 4(*e*) demonstrates strokes of the second plunger of the fuel pump 4. FIG. 4(*f*) demonstrates durations for which the first discharge pump 6 is opened. FIG. 4(*g*) demonstrates durations for which the second discharge pump 8 is opened.

As apparent from FIG. 4(*a*) to FIG. 4(*g*), the microcomputer 21 works to open the fuel injectors 12 in sequence and feed the fuel from the fuel pump 4 to the common rail 10 synchronously with the opening of each of the fuel injectors 12. Specifically, the first discharge control valve 6 is opened to feed the fuel to the common rail 10 immediately before the first group of the fuel injectors 12 are opened to spray the fuel. The second discharge control valve 8 is opened to feed the fuel to the common rail 10 immediately before the second group of the fuel injectors 12 are opened to spray the fuel. The value of the pressure of fuel in the common rail 10 sampled through the fuel pressure sensor 32 is, as indicated by broken lines in FIGS. 4(*c*), 4(*d*), and 4(*e*), used in determining the amount of fuel to be discharged by compression strokes of the first or second plungers of the fuel pump 4 which will reach the upper dead center after approximately 220° CA (crank angle).

In the example of FIGS. 4(*a*) to 4(*g*), each feeding of the fuel from the fuel pump 4 is made during an interval between adjacent two of events of injection of the fuel from the fuel injectors 12 for one of the events of injection of the fuel. Specifically, the quantity of fuel flowing out of the common rail 10 for each injection of the fuel into the engine is balanced with the quantity of fuel fed to the common rail 10 in the steady state, thus permitting the fuel to be sprayed from each of the fuel injectors 12 at a desired pressure level. In this condition, the pressure of fuel in the common rail 10, as measured by the fuel pressure sensor 32 at each of the sample times, as illustrated in FIG. 4(*c*), is kept identical with the target pressure. The target quantity of fuel to be discharged from the fuel pump 4 is calculated in step 16 of FIG. 3 by the integral term.

The engine control system may fail to produce a spray of fuel in any of the fuel injectors 12 due to a failure in energizing the fuel injector 12 arising from a wire breakage or disconnection of in either of the power supply lines for the fuel injectors 12, which will result in a mismatch in time between one or some of the injections of fuel into the engine and the feeding of the fuel from the fuel pump 4 to the common rail 10. This will also result in an unbalance between the quantity of fuel flowing out of the common rail 10 to each of the fuel injections 12 and the quantity of fuel fed to the common rail 10, thus leading to an increased variation in pressure of fuel in the common rail 10. FIGS. 5(*a*) to 5(*g*) illustrates an example where one of the first group of the fuel injectors 12 has failed to be energized or opened due to the disconnection in the power supply line which extends between the power supply circuit 24 and the first group of the fuel injectors 12.

In the illustrated example, one of the fuel injectors 12 has failed to inject the fuel into the third cylinder #3 of the engine, so that the quantity of fuel in the common rail 10 has been excessive around the time when the fuel injector 12 should inject the fuel into the third cylinder #3, thus causing the fuel in the common rail 10 to overshoot a desired level greatly. This pressure overshoot will be eliminated later by the feedback control, as illustrated in FIG. 3. However, the mismatch in time between each feeding of the fuel to the common rail 10 and one of the injections of the fuel into the engine will result in instability of the pressure of fuel in the common rail 10 and decreased controllability of the pressure in the common rail 10.

Figure 6:
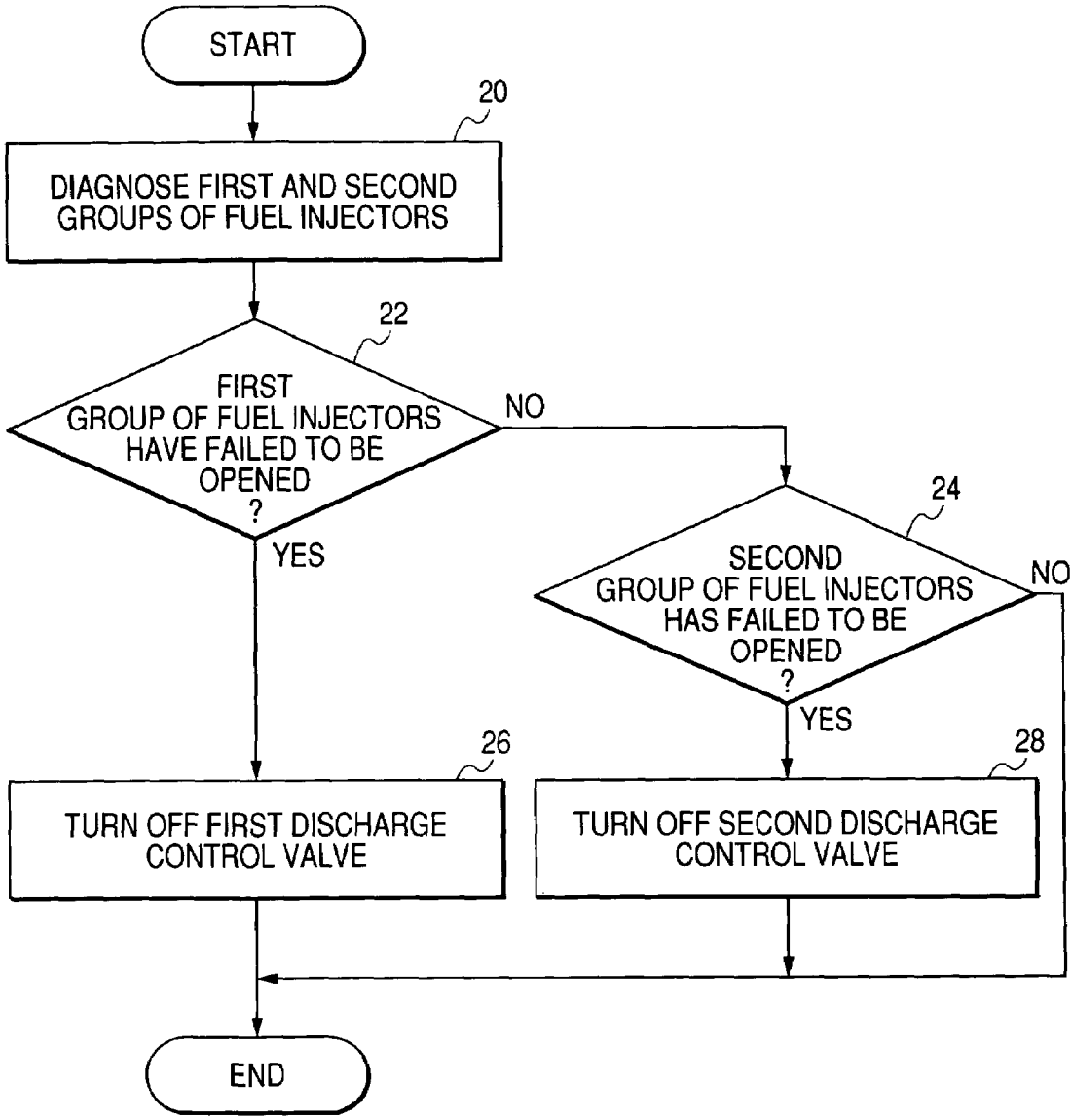
FIG. 6 is a flowchart of a fail-safe program to be executed by a microcomputer of the fuel injection control system of FIG. 1 to establish a steady balance between amounts of fuel flowing into and out of a common rail.

In order to alleviate the above problem, the microcomputer 21 works to enter a fail-safe mode to set to zero the amount of fuel to be discharged by one of the discharge control valves 6 and 8 for the first or second group which includes one of the fuel injectors 12 having failed to be energized. This fail-safe operation will be described below in detail with reference to a flowchart of a fail-safe program, as illustrated in FIG. 6. This program is executed in a cycle.

After entering the program, the routine proceeds to step 20 wherein the fuel injectors 12 are diagnosed to monitor a failure in operation thereof. Specifically, the microcomputer 21 monitors the current flowing between each of the switching devices SW1 to SW6 and ground. When having outputted on-signals to energize all the first group of the fuel injectors 12 in sequence for injecting the fuel into the first to third cylinders #1 to #3 of the engine, but not having found the flow of current from at least one of the switching devices SW1 to SW3, the microcomputer 21 determines that the first group of the fuel injectors 12 has failed to be energized or opened. When having outputted on-signals to energize all the second group of the fuel injectors 12 in sequence for injecting the fuel into the fourth to sixth cylinders #4 to #6 of the engine, but not having found the current from any of the switching devices SW4 to SW6, the microcomputer 21 determines that the second group of the fuel injectors 12 has failed to be energized or opened. Additionally, the microcomputer 21 also monitors the current flowing through the step-up transformer and the constant power supply of each of the power supply circuits 24 and 25. When not having found such a current, the microcomputer 21 also determines that a corresponding one of the first and second groups of the fuel injectors 12 has failed to be energized.

After step 20, the routine proceeds to step 22 wherein it is determined whether a failure in energizing the fuel injector(s) 12 has occurred in the first group or not. If a YES answer is obtained meaning that any of the first group of the fuel injectors 12 has failed to be energized, then the routine proceeds to step 26 wherein the microcomputer 21 deactivates the first discharge control valve 6. Alternatively, if a NO answer is obtained in step 22, then the routine proceeds to step 24 wherein it is determined whether a failure in energizing the fuel injector(s) 12 has occurred in the second group or not. If a NO answer is obtained, then the routine terminates. Alternatively, if a YES answer is obtained, then the routine proceeds to step 28 wherein the microcomputer 21 deactivates the second discharge control valve 8.

FIGS. 7(*a*) to 7(*g*) demonstrates an example where the pressure in the common rail 10 is controlled in the fail-safe mode of the microcomputer 21, as described in FIG. 6. FIGS. 7(*a*) to 7(*g*) represent the same as in FIGS. 4(*a*) to 4(*g*).

The microcomputer 12 determines that the first group of the fuel injectors has failed to be opened and deactivates the first discharged valve 6 to stop feeding the fuel to the common rail 10 for injecting the fuel into the first to third cylinders #1 to #3 of the engine. Specifically, no fuel is, as shown in FIG. 7(*d*), fed by strokes of the first plunger of the fuel pump 4 to the common rail 10. After the fuel is fed by the second discharge control valve 8 at each compression stroke of the second plunger to the common rail 10, the second group of the fuel injectors 12 are opened, in sequence, to inject sprays of fuel into the fourth to sixth cylinders #4 to #6 of the engine, thereby balancing the quantity of fuel discharged from the common rail 10 with that fed to the common rail 10 to place the pressure in the common rail 10 in the steady state. In the example of FIGS. 7(*a*) to 7(*g*), the pressure in the common rail 10, as measured by the fuel pressure sensor 32 at each of the sample times for controlling the operation of the second discharge control valve 8, is controlled to be identical with the target pressure. The target quantity of fuel to be discharged from the fuel pump 4 is calculated in step 16 of FIG. 3 by the integral term.

The engine control system of the second embodiment will be described below which is designed to reduce the amount of fuel to a preselected value which is to be outputted from the first discharge control valve 6 or the second discharge control valve 8 which is associated with one of the first and second groups of the fuel injectors 12 determined by the microcomputer 21 to have failed to be opened.

Figures 8A, 8B, 8C, 8D, 8E, 8F, 8G:
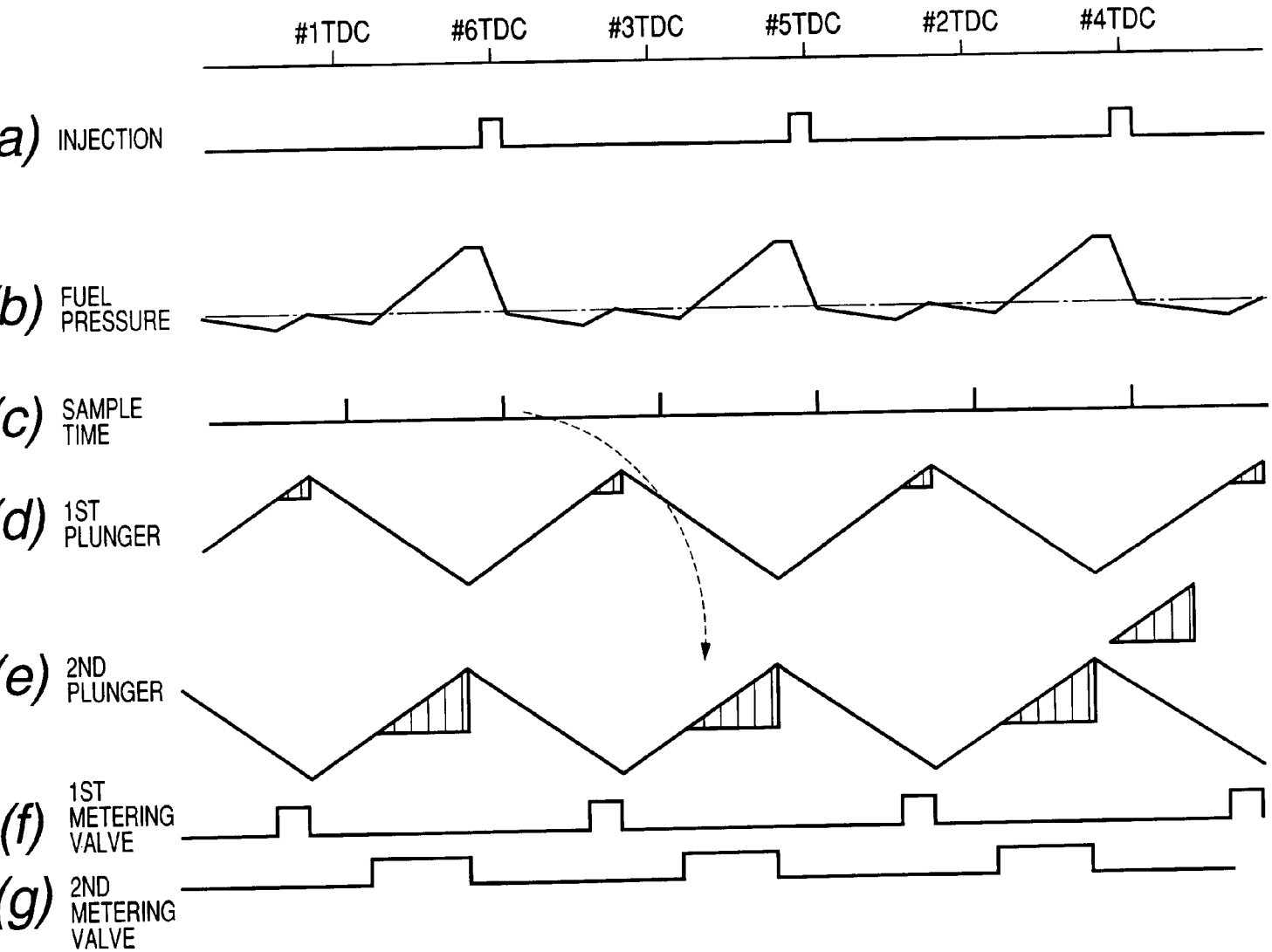
FIG. 8(*a*) demonstrates an injection period for which each fuel injector of a fuel injection system of the second embodiment is opened to spray fuel into an engine in the event of a failure in operation of a first group of the fuel injectors.

FIGS. 8(*a*) to 8(*g*) demonstrates an example where the pressure in the common rail 10 is controlled in the fail-safe mode of the microcomputer 21 of the second embodiment. FIGS. 8(*a*) to 8(*g*) represent the same as in FIGS. 4(*a*) to 4(*g*).

In the illustrated example, a failure in energizing the fuel injector(s) 12 has occurred in the first group. The microcomputer 21 works to regulate the amount of fuel to be discharged from the first discharge control valve 6 to a value which is selected to be equivalent to a portion of the quantity of fuel flowing out of the common rail 10 except the quantity of fuel injected into the engine through the fuel injectors 12, that is, a portion of a static leakage of the fuel from the common rail 10 to be compensated for by the first discharge control valve 6 when the first group of the fuel injectors 12 are operating properly. In other words, it is equivalent to the static leakage of fuel from the common rail 10 when the crankshaft of the engine is at an angle of (720÷6)° CA.

For instance, when having found a malfunctioning of the step-up transformer of the power supply circuit 24 which will result in a failure in energizing the first group of the fuel injectors 12 prior to the injection timing of the first group of the fuel injectors 12, the microcomputer 21 works to regulate the amount of fuel to be discharged from the first discharge control valve 6 to the preselected value, thereby achieving the steady balance in pressure in the common rail 10 more quickly than when the amount of fuel to be discharged from the first discharge control valve 6 is set to zero (0). Specifically, when the amount of fuel to be discharged from the first discharge control valve 6 is regulated to zero (0), much time is consumed by the second discharge control valve 8 to compensate completely for a static leakage of the fuel from the common rail 10 which should be compensated for normally by the first discharge valve 6. The microcomputer 21 of this embodiment, however, works to supply the amount of fuel to the common rail 10 under feedforward control which is to be fed through the first discharge control valve 6 for compensating for the static leakage of the fuel from the common rail 10, thereby establishing the steady balance in the pressure of the common rail 10 quickly.

Further, when the amount of fuel discharged from the fuel pump 4 is near maximum immediately before the failure in energizing, for example, the first group of the fuel injectors 12 is found, it is difficult to open only the second discharge control valve 8 for supplying the fuel to an amount which compensates for the static leakage of fuel from the common rail 10 which should be compensated for normally by using the first discharge control valve 6. The engine control system of this embodiment is useful for such an event.

Figure 9:
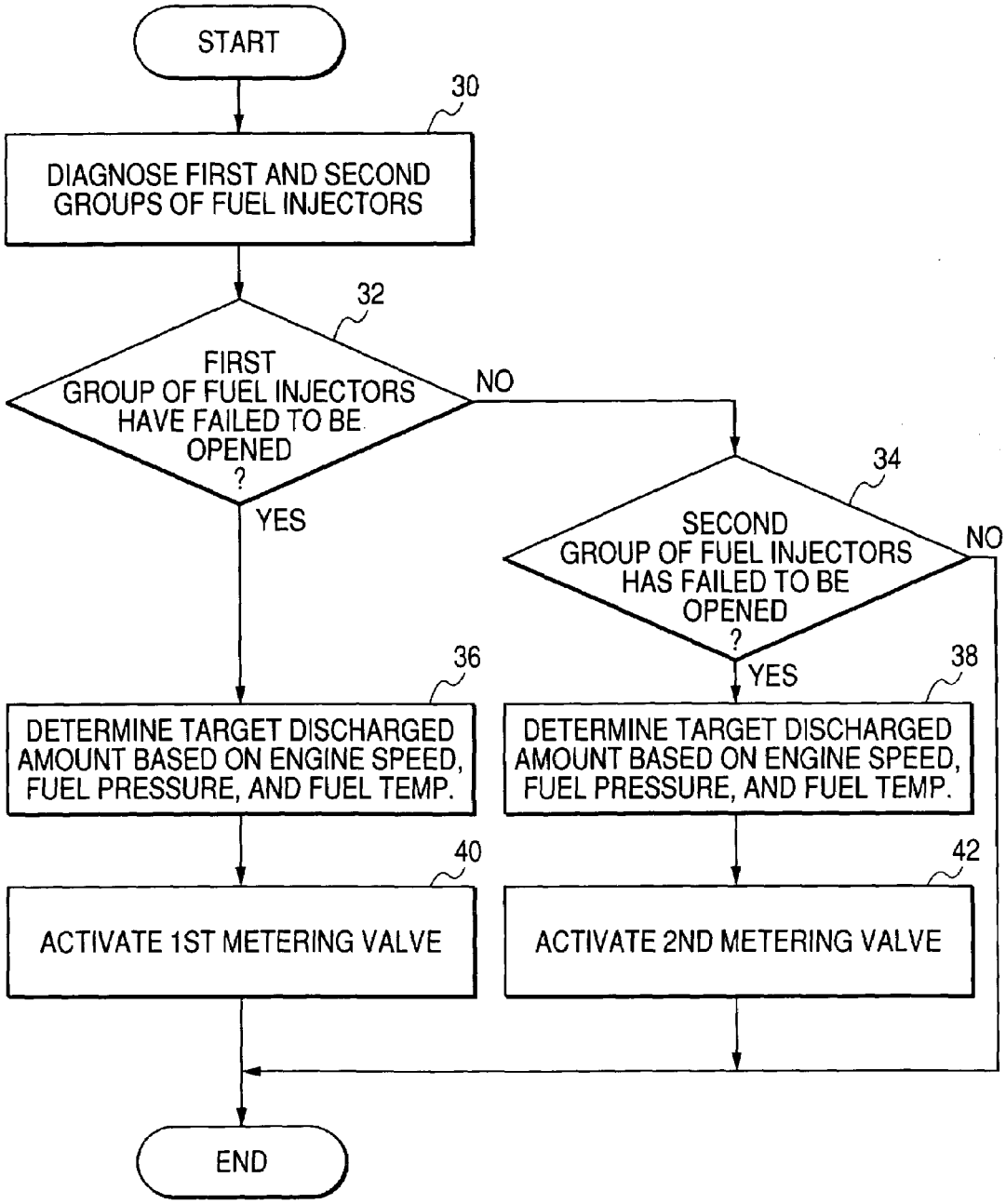
FIG. 9 is a flowchart of a fail-safe program to be executed by a microcomputer of a fuel injection control system of the third embodiment to establish a steady balance between amounts of fuel flowing into and out of a common rail.

The engine control system of the third embodiment will be described below which is designed to perform a fail-safe program, as illustrated in FIG. 9, in a cycle.

After entering the program, the routine proceeds to step 30 wherein the fuel injectors 12 are diagnosed to monitor a failure in operation thereof in the same manner as described in FIG. 6. The routine proceeds to step 32 wherein it is determined whether a failure in energizing the fuel injector (s) 12 has occurred in the first group or not. If a YES answer is obtained meaning that any of the first group of the fuel injectors 12 has failed to be energized, then the routine proceeds to step 36 wherein a target amount of fuel to be discharged by the first discharge control valve 6 is determined based on the speed of the engine, the pressure of fuel in the common rail 10, and the temperature of the fuel in the common rail 10, as measured by the fuel pressure sensor 32, the crank angle sensor 34, and the fuel temperature sensor 36. Specifically, the target amount of fuel is determined to be an amount required for compensate for the static leakage of fuel from the common rail 10 in the same manner as described in the second embodiment. The static leakage usually depends upon the speed of the engine, the pressure of fuel in the common rail 10, and the temperature of the fuel in the common rail 10. The target amount is, therefore, determined as a function of such three parameters. The routine then proceeds to step 40 wherein the first discharge control valve 6 is opened to feed the target amount of fuel to the common rail 10.

If a NO answer is obtained in step 32, then the routine proceeds to step 34 wherein it is determined whether a failure in energizing the fuel injector(s) 12 has occurred in the second group or not. If a NO answer is obtained, then the routine terminates. Alternatively, if a YES answer is obtained, then the routine proceeds to step 38 wherein a target amount of fuel to be discharged by the second discharge control valve 8 is determined, like in step 36, based on the speed of the engine, the pressure of fuel in the common rail 10, and the temperature of the fuel in the common rail 10, as measured by the fuel pressure sensor 32, the crank angle sensor 34, and the fuel temperature sensor 36. The routine then proceeds to step 42 wherein the second discharge control valve 8 is opened to feed the target amount of fuel to the common rail 10.

The engine control system of the fourth embodiment will be described below which is designed to diagnose each of the fuel injectors 12 on a unit basis, not a group basis. Specifically, the microcomputer 21 is designed to monitor the current flowing between each of the switching devices SW1 to SW6 and ground. When having outputted the on-signals to energize the fuel injectors 12 in sequence for injecting the fuel into the engine, but not having found the flow of current from one(s) of the switching devices SW1 to SW6, the microcomputer 21 determines that the one(s) of the fuel injectors 12 has failed to be energized or opened and enters a fail-safe mode, as demonstrated in FIGS. 10(*a*) to 10(*g*).

FIGS. 10(*a*) to 10(*g*) illustrates an example where the pressure in the common rail 10 is controlled in the fail-safe mode of the microcomputer 21 of the fourth embodiment. FIGS. 10(*a*) to 10(*g*) show the same as in FIGS. 4(*a*) to 4(*g*).

In the illustrated example, a failure in energizing the fuel injector(s) 12 has occurred in two of the fuel injectors 12 working to inject the fuel into the sixth and second cylinders #6 and #2 of the engine. When having found such an event, the microcomputer 21 enters the fail-safe mode and sets the amount of fuel to zero (0) which is to be discharged from the fuel pump 4 at each of times immediately before injection timings at which the fuel is injected into the sixth and second cylinders #6 and #2, respectively. This ensures the steady balance between amounts of fuel flowing into and out of the common rail 10. FIGS. 10(*a*) to 10(*g*) illustrate the example where the amount of fuel flowing into the common rail 10 is balanced with that flowing out of the common rail 10, thereby bringing the pressure of fuel in the common rail 10 represented by a solid line in FIG. 10(*b*), as measured by the fuel pressure sensor 32 at each of the sample times, as illustrated in FIG. 10(*c*), into agreement with the target pressure represented by a broken line. The target quantity of fuel to be discharged from the fuel pump 4 is calculated in step 16 of FIG. 3 by the integral term.

The engine control system of the fifth embodiment will be described below which is designed to decimate the sample times when the fuel in the common rail 10 is sampled for use in the feedback control, as discussed in FIG. 3, when one(s) of a preselected group of the fuel injectors 12 is determined to have failed to be energized. Specifically, the microcomputer 21 works to change a sampling cycle in which the pressure in the common rail 10 is sampled synchronously with the time when each of the first and second plungers of the fuel pump 4 reaches the top dead center to that synchronous with the injection of fuel into the engine.

FIGS. 11(*a*) to 11(*g*) illustrates an example where the pressure in the common rail 10 is controlled in the fail-safe mode of the microcomputer 21 of the fifth embodiment. FIGS. 11(*a*) to 11(*g*) show the same as in FIGS. 4(*a*) to 4(*g*).

In the illustrated example, the fuel injectors 12 are, like the first embodiment, broken down into the first and second groups. The power supply line for the first group of the fuel injectors 12 is failing to energize the fuel injectors 12. When having found such a problem, the microcomputer 21 defines times immediately after when the second plunger reaches the top dead center as the sample times at which the pressure in the common rail 10 is to be sampled through the fuel pressure sensor 32 for use in the feedback control of the pressure in the common rail 10. This ensures the steady balance between amounts of fuel flowing into and out of the common rail 10, thereby bringing the pressure of fuel in the common rail 10 represented by a solid line in FIG. 11(*b*), as measured by the fuel pressure sensor 32 at each of the sample times, as illustrated in FIG. 11(*c*), into agreement with the target pressure represented by a broken line. The target quantity of fuel to be discharged from the fuel pump 4 is calculated in step 16 of FIG. 3 by the integral term.

The engine control system of each of the above first to fifth embodiment may be modified in the following manner.

The microcomputer 21 of the fifth embodiment may alternatively be designed to, instead of decimating the sample times, determine half the target amount of fuel, as derived in step 16 of FIG. 3, as that to be discharged through the first discharge control valve 6 or the second discharged control valve 8 which is associated with one of the first and second groups of the fuel injectors 12 which has been determined as failing to be energized.

Figures 12A, 12B, 12C, 12D, 12E, 12F, 12G:
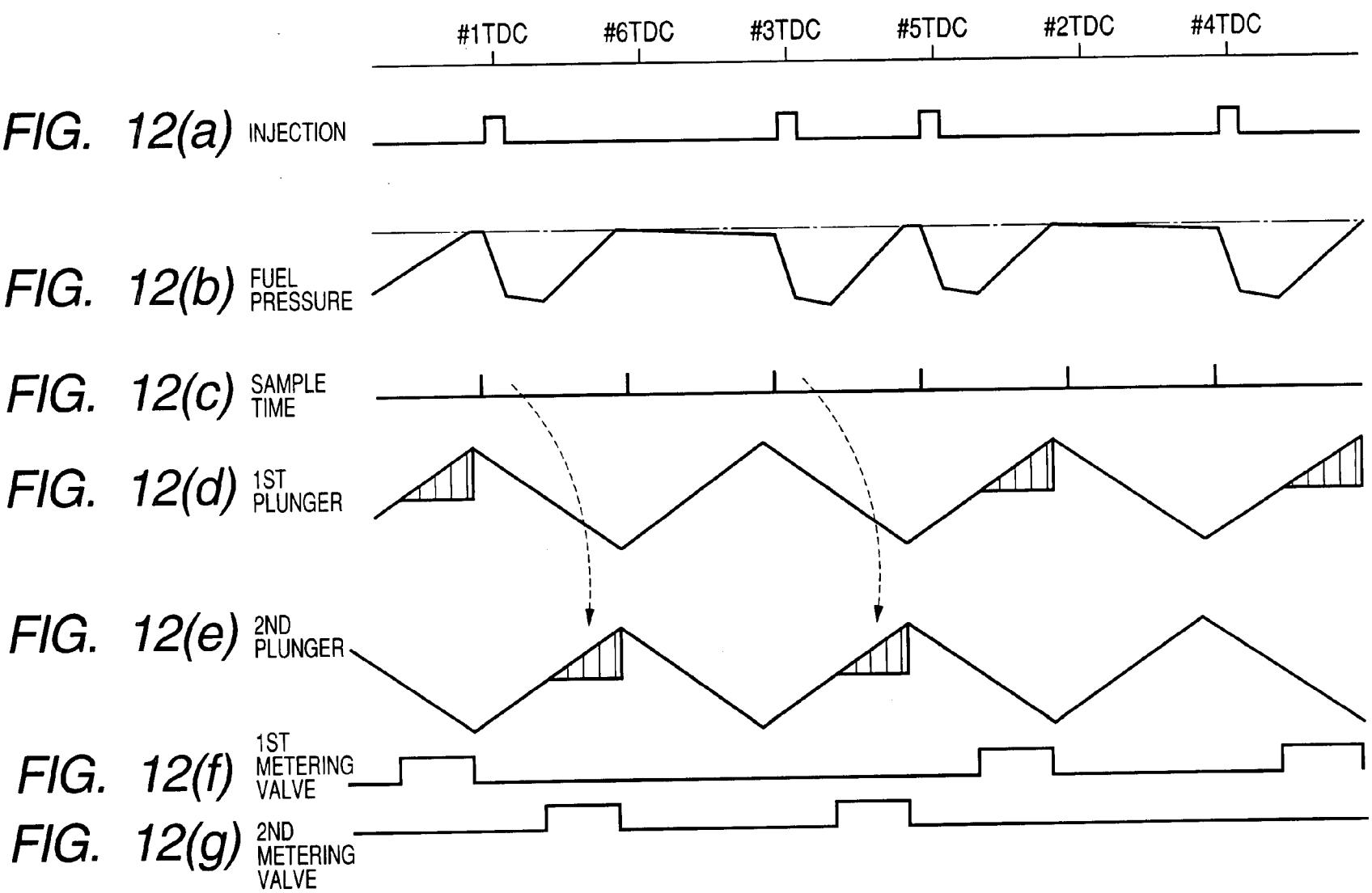
FIG. 12(*a*) demonstrates an injection period for which each fuel injector of a modified form of a fuel injection system of the fourth embodiment is opened to spray fuel into an engine in the event of a failure in operation of two of the fuel injectors.

FIGS. 12(*a*) to 12(*g*) illustrate a modification of the fail-safe mode to control the pressure in the common rail 10 in the fourth embodiment designed to set the amount of fuel to zero (0) which is to be discharged from the fuel pump 4 at each of times immediately before injection timings at which the fuel is injected by one(s) of the fuel injectors 12 which is determined as having failed to be energized properly. In the illustrated example, the microcomputer 21 works to set the amount of fuel to zero (0) which is to be discharged from the fuel pump 4 at each of times immediately after injection timings at which the fuel is injected by one(s) of the fuel injectors 12 which is determined as having failed to be energized properly. The microcomputer 21 works to sample the pressure in the common rail at the sample times defined within intervals during which no fuel is inputted to or outputted from the common rail 10 between the feeding of fuel to the common rail 10 from the fuel pump 4 and the injection of fuel into the engine.

The fuel pump 4, as used in each of the first to fifth embodiments, may be engineered to have two plungers and a single discharge control valve which is controlled to be opened during the compression stroke of each of the two plungers. The numbers of the plungers and the discharged control valves are not limited to the ones, as described above.

The fuel pump 4 may alternatively be equipped with suction control valves instead of the discharge control valves 6 and 8. The suction control valves work to control the amount of fuel to be sucked into the fuel pump 4 from the fuel tank 2. The discharge control valves 6 and 8 or the suction control valves may be designed to be switched by an on-off signal between a fully closed position and a fully open position or to have a selected position between the fully closed and fully open positions.

The microcomputer 21 may alternatively be designed to calculate the amount of fuel required to compensate for a change in the target pressure of fuel in the common rail 10 using a feedforward term in the PID algorithm to control the pressure in the common rail 10 accurately.

The engine control system of each of the above embodiments may alternatively be designed as an asynchronous system in which times when the fuel is supplied to the common rail 10 do not coincide with those when the fuel is sprayed by the fuel injectors 12 into the engine. The operation of this type of asynchronous system is demonstrated in FIGS. 13(*a*) to 13(*g*).

Figures 13A, 13B, 13C, 13D, 13E, 13F, 13G:
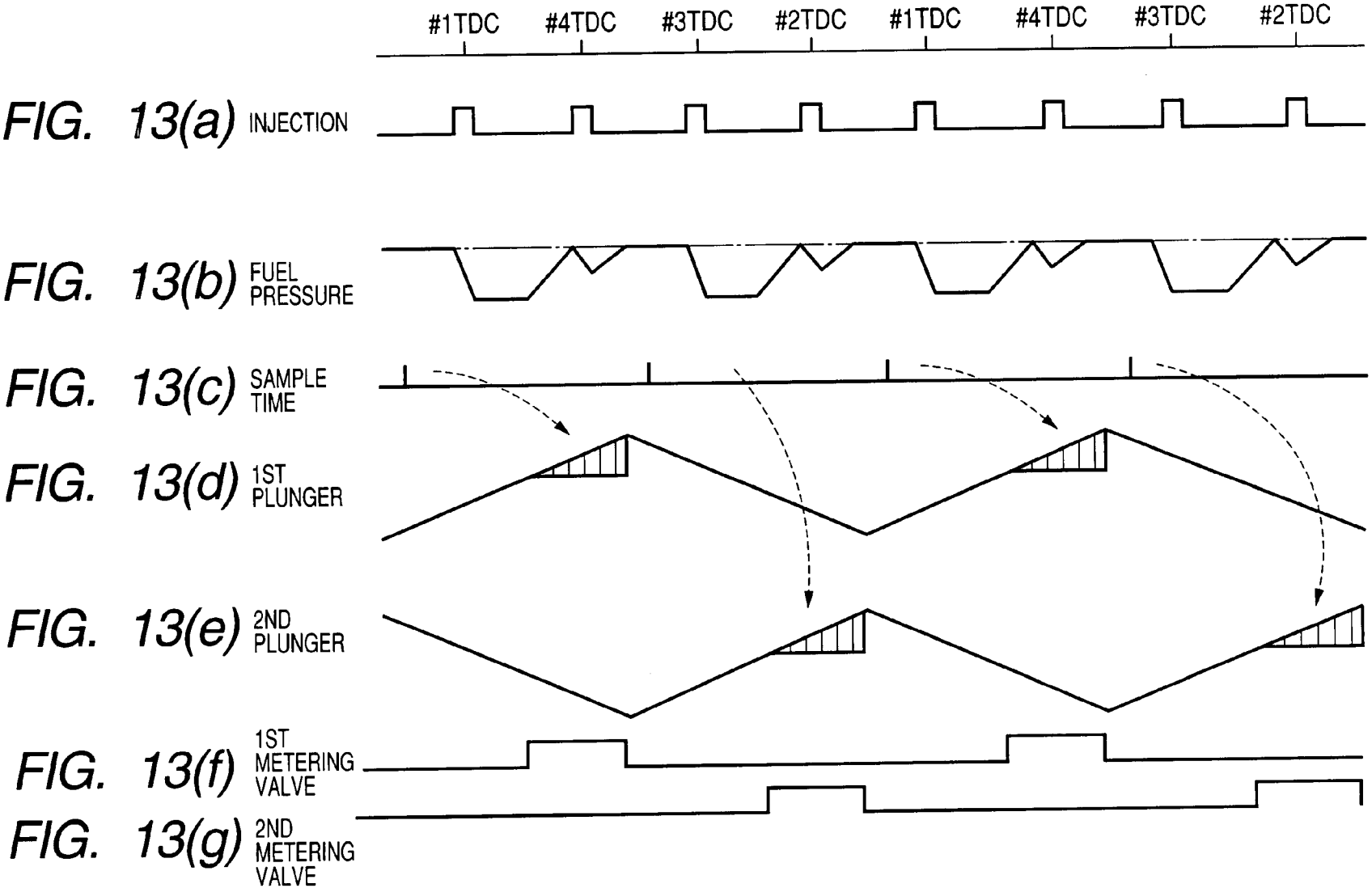
FIG. 13(*a*) demonstrates an injection period for which each fuel injector of a modification of a fuel injection system is opened to spray fuel into an engine.
Figures 14A, 14B, 14C, 14D, 14E, 14F, 14G:
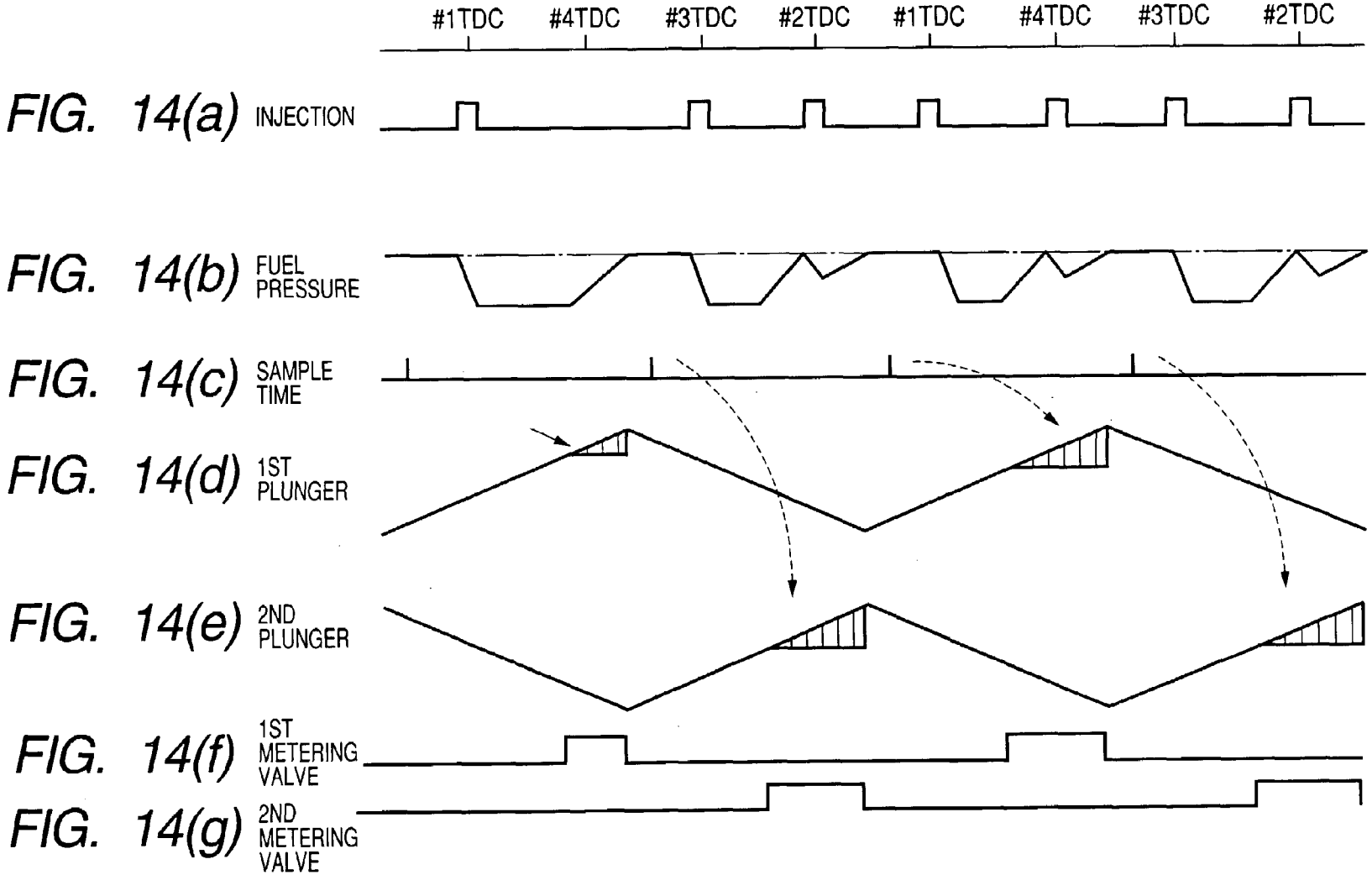
FIG. 14(*a*) demonstrates an injection period for which each fuel injector of the fuel injection system, as referred to in FIG. 13(*a*), is opened to spray fuel into an engine in the event of a failure in operation of one of the fuel injector.

In the illustrated example, a ratio of the amount of fuel fed to the common rail 10 to that injected from the common rail 10 into the engine 10 is 1:2. Specifically, the amount of fuel consumed from the common rail 10 by two injections of the fuel into the engine is compensated for by a single pumping stroke of the fuel pump 4. FIG. 13(*b*) illustrates a change in pressure in the common rail 10 established by the steady balance between the amount of fuel fed to the common rail 10 and that flowing out of the common rail 10. The pressure of fuel in the common rail 10 represented by a solid line in FIG. 11(*b*), as measured by the fuel pressure sensor 32 at each of the sample times, as illustrated in FIG. 11(*c*), into agreement with the target pressure represented by a broken line. The target quantity of fuel to be discharged from the fuel pump 4 is calculated in step 16 of FIG. 3 by the integral term.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

The microcomputer 21 of each of the embodiments may be designed to diagnose a failure in opening each of the fuel injectors 12 to a desired position, that is, a failure in injecting a desired quantity of fuel into the engine due to causes other than the disconnection of the power supply lines for the fuel injectors 12 and enter the fail-safe mode in the event of such a failure. The microcomputer 21 may also be designed to diagnose a failure in opening the fuel injectors 12 due to a mechanical lock arising from, for example, intrusion of foreign objects into the fuel injectors 12.

What is claimed is:

1. A fuel injection control system comprising:

a fuel pump works to feed fuel;

an accumulator in which the fuel fed from said fuel pump is to be accumulated at a given pressure;

fuel injectors each of which works to inject the fuel supplied from said accumulator into one of cylinders of a multi-cylinder internal combustion engine;

a fuel pressure sensor working to measure a pressure of the fuel in said accumulator; and a controller working to energize said fuel injectors to inject the fuel at a sequence of given injection timings into the cylinders of the engine and also to control an operation of said fuel pump to feed an amount of the fuel to said accumulator at a sequence of controlled times for compensating for an amount of the fuel which flows out of said accumulator to bring the pressure of the fuel in said accumulator, as measured by said fuel pressure sensor, into agreement with a target value under feedback control, said controller being designed to perform a diagnosis function to diagnose whether at least one of said fuel injectors has failed in operation or not, when it is determined that at least one of said fuel injectors has failed in operation, said controller altering a mode of the feedback control to decrease the amount of fuel fed from said fuel pump to said accumulator at one of the sequence of the controlled times which is at a selected interval away from one of the sequence of the injection timings at which the at least one of said fuel injectors is to be energized to inject the fuel into the engine.

2. A fuel injection control system as set forth in claim 1, wherein said controller works in a synchronization mode to control the operation of said fuel pump to feed the amount of the fuel to said accumulator synchronously with the injection of the fuel into the engine through each of said fuel injectors, and wherein when it is determined that the at least one of said fuel injectors has failed in operation, said controller alters the mode of the feedback control to decrease the amount of fuel fed from said fuel pump to said accumulator at one of the sequence of the controlled times which is adjacent to one of the sequence of the injection timings at which the at least one of said fuel injectors is to be energized to inject the fuel into the engine.

3. A fuel injection control system as set forth in claim 2, wherein said fuel injectors are broken down into groups, and further comprising power supply lines each of which supplies electric power to energize one of the groups of said fuel injectors, and wherein said fuel pump is equipped with metering valves, one for each of the groups of said fuel injectors, which work to regulate the fuel fed from said fuel pump to said accumulator to an amount required by said controller, when it is determined that the at least one of said fuel injectors has failed in operation, said controller working to alter the mode of the feedback control to decrease the amount of fuel, as regulated by one of the metering valves which is associated with one of the groups including the at least one of said fuel injectors.

4. A fuel injection control system as set forth in claim 3, wherein when it is determined that the at least one of said fuel injectors has failed in operation, said controller works to alter the mode of the feedback control to decrease the amount of fuel, as regulated by the one of the metering valves which is associated with the one of the groups including the at least one of said fuel injectors to zero.

5. A fuel injection control system as set forth in claim 3, wherein when it is determined that the at least one of said fuel injectors has failed in operation, said controller works to alter the mode of the feedback control to decrease the amount of fuel, as regulated by the one of the metering valves which is associated with the one of the groups including the at least one of said fuel injectors to a predetermined value.

6. A fuel injection control system as set forth in claim 1, wherein said controller works in a synchronization mode to control the operation of said fuel pump to feed the amount of the fuel to said accumulator synchronously with the injection of the fuel into the engine through each of said fuel injectors to bring the pressure of the fuel in said accumulator, as sampled through said fuel pressure sensor in a sampling cycle, into agreement with the target value under the feedback control, wherein said fuel injectors are broken down into groups, and wherein when it is determined that at least one of said fuel injectors has failed in operation, said controller works to alter the mode of the feedback control to change the sampling cycle.

* * * * *